United States Patent [19]

Schneider

[11] Patent Number: 4,464,060

[45] Date of Patent: Aug. 7, 1984

[54] ELECTRONIC CHESS CLOCK

[76] Inventor: Manfred Schneider, Miesenbacher Strasse 16, 6792 Ramstein-Miesenbach 1, Fed. Rep. of Germany

[21] Appl. No.: 481,852

[22] Filed: Apr. 4, 1983

[30] Foreign Application Priority Data

Apr. 7, 1982 [DE] Fed. Rep. of Germany ... 8209994[U]

[51] Int. Cl.[3] ..... G04F 3/00

[52] U.S. Cl. ..... 368/96

[58] Field of Search ..... 368/76, 80, 96, 223, 368/228

[56] References Cited

U.S. PATENT DOCUMENTS

| | | | |
|---|---|---|---|
| 2,079,204 | 5/1937 | Foster | 368/96 |
| 2,539,754 | 1/1951 | Rettinger et al. | 368/96 |
| 4,021,046 | 5/1977 | Barlow | 368/96 X |

*Primary Examiner*—Vit W. Miska

*Attorney, Agent, or Firm*—Toren, McGeady and Stanger

[57] ABSTRACT

An electronic chess clock includes a generally rectangular casing atop which an elongate switching lever is mounted for pivotal movement about the center of the lever. A pair of electrochemical clockworks are contained in the casing for measuring and displaying time periods representing deliberation time of the chess players. A selected one of the two clockworks is actuated when the switching lever is pivoted downwardly at one end to actuate a microswitch associated with the selected clockwork. A common quartz-controlled time module provides time pulses to the selected one of the clockworks to insure that both of the clockworks operate at an equal rate. A manually actuable change-over switch coupled to the time module operates to allow the frequency of the time pulses to be selected so that the hand of the clockworks can indicate elapsed time on an expanded scale for greater accuracy in "short time" chess matches.

12 Claims, 2 Drawing Figures

ELECTRONIC CHESS CLOCK

BACKGROUND OF THE INVENTION

The invention relates to an electronic chess clock with a generally rectangular casing containing two clockworks each with a clock face and a set of hands. An adjusting device is provided for each of the clockworks at the rear of the casing to set the hands, and a change-over device is located at the top of the casing by which one or both of the clockworks can be stopped.

Such chess clocks have been known generally for some time, and are commercially available. The clocks use spring operated clockworks with a balance which can be stopped by means of a mechanical brake actuated from the top of the casing. The brake for each clockwork is attached to a type of switching lever. Both clockworks can be stopped when the switching lever is in an intermediate position, for example, when both clocks must be stopped during a game interruption.

After relatively short use of about half a year, the known mechanical chess clocks develop a relatively high inaccuracy in operation. In addition, some models can easily be "manipulated". One example of such manipulation can be the setting ahead by one player of the rate controller of his opponent's clockwork, while setting back the rate controller of his own clockwork. Another possibility for manipulation arises through the construction of the brake, wherein a sudden actuation of the switch on the top of the casing causes the balance to accelerate strongly and thus shorten the opponent's time.

Today, two types of chess clocks are in use for tournaments. One type is used during standard matches wherein, except for the brake, the clockwork corresponds completely in design and construction to a conventional clockwork. The other type is used during very short matches and resembles a type of short time meter for a maximum match time of 15 minutes.

All chess clocks have in common the fact that they provide an analogous representation of game time with two separate, alternately running and stopping indicators, and the clock faces and change-over devices are arranged in such a way that their positions are visible from a great distance. Also, the clocks lack acoustical or optical signal devices with the exception of a drop leaf which is actuated by the minute hand.

A chess clock is known from German Utility Model No. 78 20 464, in which quartz-controlled electronic timework controls a digital indicator which is equipped with a liquid crystal display. However, this electronic chess clock was not accepted for tournament use, because it did not meet the regulations of the chess club nor the requirements of the chess players involved.

SUMMARY OF THE INVENTION

An object of the present invention is to provide a chess clock which can be used in standard tournaments or matches, in short matches, and also in very short matches, wherein the clock operates with much greater accuracy than the present chess clocks, and is arranged so that it practically can not be manipulated.

According to the invention, a chess clock includes a casing the top of which has an opening which is covered by an elongate switching lever. Two microswitches are mounted in the casing, each near a corresponding end of the switching lever so that the contact of each microswitch closes when the corresponding end of the switching lever is completely pressed down. Two electromechanical clockworks and at least one quartz-controlled time module for generating electrical time pulses are provided. A change-over switch having three readily visible switching positions is arranged to be actuated manually and serves to control the clockworks with electrical time pulses from the time module at a selected one of a single and a double frequency. The clockworks include clock faces each having a first dial on which hour marks are inscribed in the clockwise direction, and a second dial concentric with the first dial on which minute marks are inscribed counterclockwise.

The chess clock of the present invention has the advantage that both clockworks are driven by pulses from a common time module, so that both clocks run exactly as fast as one another. Further, notwithstanding the provision of electronic time pulses, the accepted and proven appearance of the timeworks and the change-over device are maintained. Moreover, the same clock can be used for standard, short and very short matches through the use of pulses of twice the basic frequency to obtain a double expansion with respect to time, and consequently a doubling of measurement accuracy is achieved.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
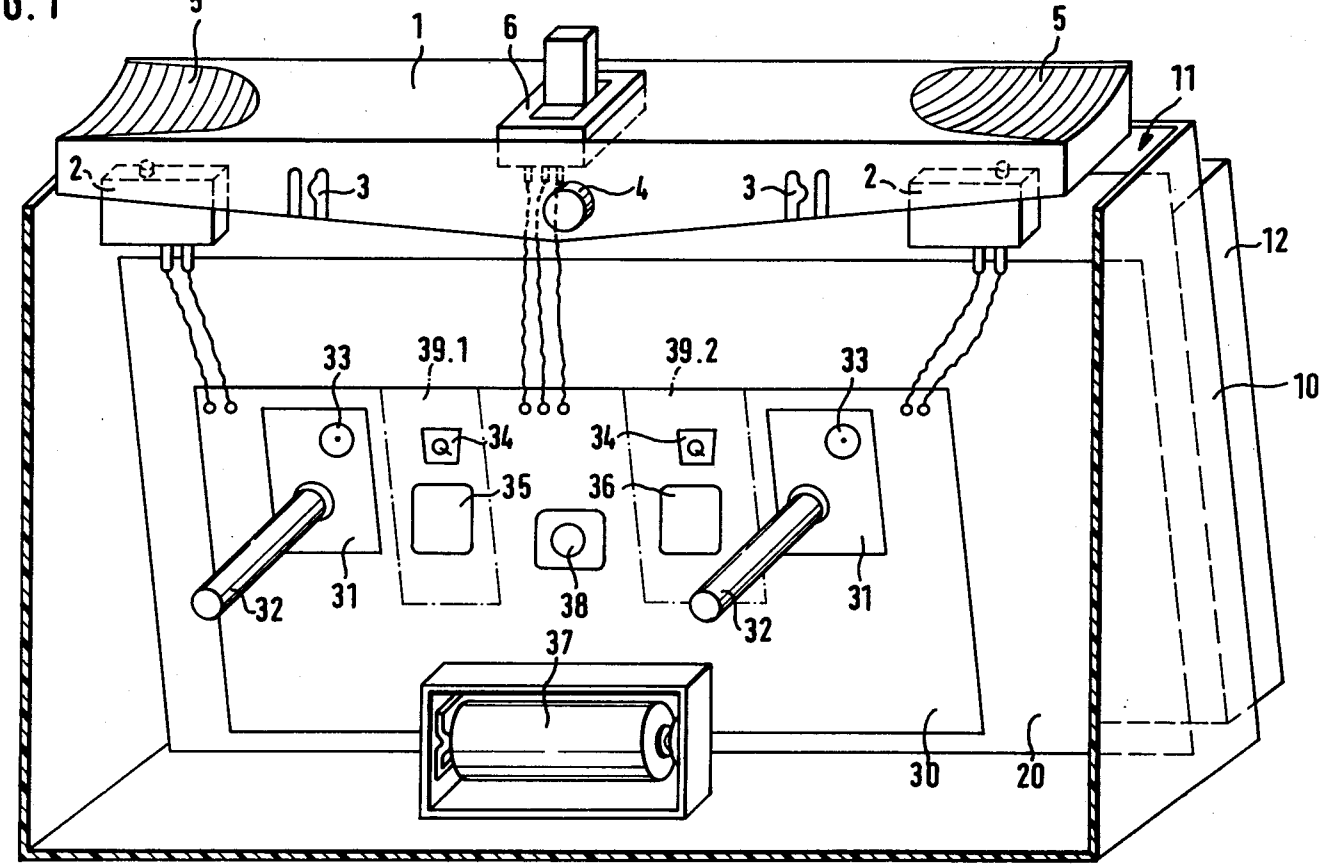
FIG. 1 is a perspective view from the rear of a chess clock according to the invention, wherein a rear wall is cut away to show the interior of the clock casing.

FIG. 1 shows a quartz-controlled, electronic chess clock according to the invention, including several structural components. A first structural component, a switching assembly, comprises an elongate switching lever 1 which is supported for pivotal movement about its center by a shaft 4 supported centrally at the top front and rear of a casing 10. Two conventional microswitches 2 mounted at the top left and right sides of the casing 10 are arranged to be actuated by alternatingly pressing down corresponding ends of the switching lever 1. Stop dimples 3 on the side of the switching lever 1 are arranged to interact with corresponding indentations (not shown) on the rear wall and/or the front wall of the casing 10 to exert a force to counter the spring action of the microswitches 2, so that the switching lever 1 remains in a pressed down position. Finger depressions 5, compatible with the shape of the fingers, are formed by slight depressions having shallow transverse grooves at each end of the switching lever 1 so as to provide good feel.

A three-position change-over switch 6 is mounted at the top center of the switching lever 1. The switch 6 is arranged so that it is actuated by applying a force transversely of the longitudinal axis of the switching lever 1.

The change-over switch 6 serves to set the chess clock either to "standard time", "very short time", or to "off".

A second structural component, the casing 10, is of generally rectangular shape and has a front surface which is rearwardly inclined from bottom to top, and an open top defining an opening 11. The opening 11 at the top of the casing 10 is substantially covered by the switching lever 1. A box-shaped plastic glass 12 is arranged at the front of the casing for allowing a pair of clock faces 27 to be viewed. The casing 10 may be die-cast of plastics material.

Further, the switching lever 1 is arranged so that its ends move partially through the opening 11 at the top of the casing 10 and into the casing when the ends are pivoted to actuate the microswitches 2.

A third structural component is a clock face carrier 20 whose construction and operation will be described further below with the aid of FIG. 2.

A fourth structural component is a printed circuit board 30 on which electrical and electronic parts are mounted. Two conventional clockworks 31 are driven by an electric stepping motor. The clockworks 31 each have a setting spindle 32 at the rear for manual setting of the hands (see FIG. 2). The setting spindles 32 project beyond the rear wall (not shown) of the casing 10, so that the hands of both clockworks can be set manually. Also, a rear support 33 for the hour, minute and second spindle of each of the clockworks 31 is visible.

Two time modules 39.1 and 39.2 are also mounted on the circuit board 30. One module 39.1 generates time pulses at a frequency of 1 Hz for control of each one of the two clockworks 31, and the other module 39.2 generates time pulses at a frequency of 2 Hz. The time modules 39.1, 39.2 each contain one integrated switching circuit 35, 36 and are precisely time controlled by a quartz resonator 34 associated with each of the modules.

It was discovered that the use of the second time module 39.2 with a special integrated switching circuit 36 for the generation of time pulses at twice the frequency is more economical and operationally safe, than the use of a single time module to produce the two required frequencies simultaneously. This is so mainly because the clockworks 31 are conventional, and thus are designed for 1 Hz time pulses. Pulses of higher frequencies can only be processed when the pulse shape and duration meet special requirements. If different clockworks are used, the generation of both pulse rows at different frequencies would also be possible with a single time module.

The circuit board 30 also includes a battery box with a battery 37 mounted in the region of the inside bottom of the casing 10. The battery box and the battery 37 are accessible through a corresponding opening in the rear wall (not shown) of the casing 10. Further, the circuit board 30 includes a battery control circuit 38 with a test push button and a control lamp which can be activated and observed from the rear of the chess clock, tb check the condition of the battery.

Figure 2:
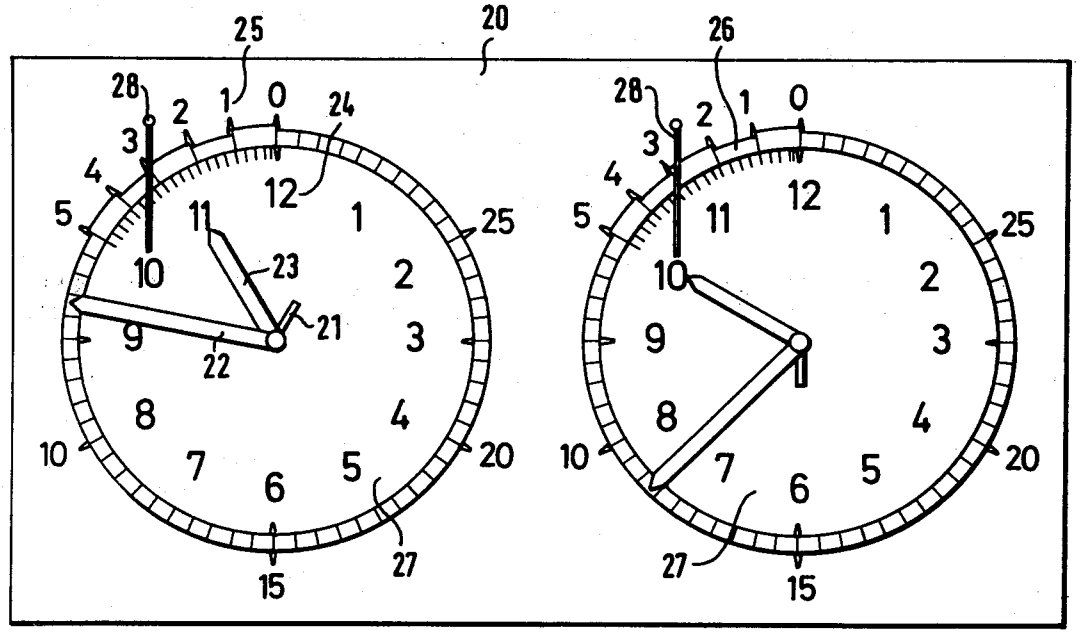
FIG. 2 is a partial front view of the chess clock showing the clock faces.

In FIG. 2, the clock face carrier 20 is shown with two complete clock faces 27 thereon, as is known from conventional chess clocks. A second hand 21 has a length which is greatly shortened relative to other hands on each clock face, and serves only to indicate that the clock is running. A minute hand 22, as well as an hour hand 23 are also shown. Each clock has a first dial 24 which is inscribed with the hours from 1 to 12 in the clockwise direction. A second dial 25 is arranged concentrically with the first dial 24, and is inscribed with the minutes from 0 to 25 in the counterclockwise direction. The second dial 25 is expanded twice with respect to time relative to the first dial 24, i.e., thirty minutes are indicated over an angle of 360°. In order to prevent misunderstanding, the two dials 24 and 25 preferably are of different color. In addition, a period of five minutes which is used for very short chess games is specially marked at 26 on the second dial 25. Here, additional dividing lines for every 15 seconds, or dividing lines for every ten seconds also may be marked.

A drop leaf 28 is provided for each clockwork as is known in conventional chess clocks. The drop leaf 28 is lifted by the minute hand 22. The length of each drop leaf 28 is selected so that it drops from the point end of the minute hand 22 when the hand points exactly at twelve on the first dial 24.

The operation of the chess clock is as follows. First, the switch 6 at the top of the casing 10 (switch 6 may also be arranged at another suitable location) is set from an "off" position into either a "standard time" position, or into a "very short time" position. Depending on the selected position of the switch 6, either the first time module 39.1 or the second time module 39.2 is supplied with voltage from the battery 37. No voltage is supplied to the remaining time module. The selected time module 39.1 or 39.2 now generates time pulses in regular intervals which pulses reach one of the contacts of the two microswitches 2. In a neutral position of the switching lever 1, as shown in FIG. 1, however, neither microswitch 2 is actuated so that the time pulses do not reach either of the clockworks 31. If one of the chess players activates one end of the switching lever 1, then the corresponding one of the two microswitches 2 is closed and the time pulses reach the clockworks 31 of the opponent whose deliberation time then begins. As soon as the opponent makes his move, he presses down his end of the switching lever 1 and the previously closed microswitch opens while the previously opened microswitch closes. The time pulses are now conducted to the other clockwork and the first player's deliberation time begins.

To preset a deliberation time of, for example, 2.5 hours, the switching lever 1 is placed at the neutral position and both clockworks are set from the rear of the casing by the mechanical setting spindles to 9:30 hours, so that the end of the game time can be recognized at the 12-hour position of the hour and minute hands.

In order to prevent the change-over switch 6, which in the illustrated embodiment is integrated in the switching lever 1, from being unintentionally or intentionally actuated during actuation of the switching lever 1, simple safety measures can be provided. It is, for example, possible to construct the switching lever in such a way that it can be actuated only with the aid of a tool or a key, or a connecting link guide may be provided which requires movement of the switching button in two planes.

The chess clock according to the invention combines two conventional chess clocks in a single unit, and further provides a considerably improved measurement accuracy, means for reducing the possibility of manipulation practically to zero, and a considerably improved service life without having to change the recognized and proven appearance of tournament chess clocks.

While specific embodiments of the invention have been shown and described in detail to illustrate the application of the inventive principles, it will be understood that the invention may be embodied otherwise without departing from such principles.

What is claimed is:

1. An electronic chess clock, comprising a generally rectangular casing, an elongate switching lever mounted on said casing for pivotal movement about the center of said switching lever, two microswitches each mounted within said casing in operative relation to a corresponding end of said switching lever so that a selected one of said two microswitches is actuated when the corresponding end of said switching lever is pivoted toward the selected microswitch, two electromechanical clockworks contained in said casing for measuring and displaying time periods in response to actuation of said microswitches by said switching lever wherein each of said clockworks is associated with a different one of said microswitches, each of said clockworks including a set of hands and a clock face having a first dial for displaying elapsed hours in a clockwise direction and a second dial, concentric with said first dial, for displaying elapsed minutes in a counterclockwise direction, quartz-controlled time module means associated with said clockworks for generating time pulses at a first frequency and at least a second frequency, and a manually actuable change-over switch coupled to said time module means for controlling operation of said clockworks wherein said time pulses at said first frequency are provided from said time module means to a selected one of said clockworks when said change-over switch is in a first position, and said time pulses at said second frequency are provided from said time module means to the selected one of said clockworks when said change-over switch is in a second position.

2. A chess clock according to claim 1, wherein said casing has a front surface inclined rearwardly from the bottom toward the top of said casing.

3. A chess clock according to claim 1, including stop devices on said switching lever for engaging corresponding indentations in said casing to hold said switching lever in the positions at which said switching lever actuates said microswitches.

4. A chess clock according to claim 1, wherein said casing has a top opening and said switching lever is arranged to move partially through said top opening into said casing when the ends of said switching lever are pivoted to actuate said microswitches.

5. A chess clock according to claim 1, wherein said time module means comprises two quartz-controlled time modules, and said change-over switch operates to apply a supply voltage to one of said two modules when in said first position and to apply the supply voltage to the other one of said two modules when in said second position.

6. A chess clock according to claim 5, wherein said one time module generates pulses at a frequency of 1 Hz, and the other time module generates pulses at a frequency of 2 Hz.

7. A chess clock according to claim 1, wherein said change-over switch is mounted on said switching lever.

8. A chess clock according to claim 1, wherein said set of hands includes a second hand which is shorter than the remaining hands of said set for indicating that the associated clockwork is in operation.

9. A chess clock according to claim 1, including battery control means comprising a test push button and control lamp for determining the condition of a battery voltage source.

10. A chess clock according to claim 1, wherein said casing is die-cast of plastics material.

11. A chess clock according to claim 1, including a box-like glass arranged to enclose the front of said casing and to allow the clock faces of said two clockworks to be viewed.

12. A chess clock according to claim 1, wherein said second dial indicates a time of 30 minutes over an angle of 360°.

* * * * *